US011786936B2

(12) United States Patent
Carrasco

(10) Patent No.: US 11,786,936 B2
(45) Date of Patent: Oct. 17, 2023

(54) SEPARATION DEVICE AND METHOD OF OPERATION

(71) Applicant: A O IDEAS GmbH, Schocherswil (CH)

(72) Inventor: César Carrasco, Schocherswil (CH)

(73) Assignee: A O IDEAS GMBH, Schocherswil (CH)

( * ) Notice: Subject to any disclaimer, the term of this patent is extended or adjusted under 35 U.S.C. 154(b) by 0 days.

(21) Appl. No.: 17/631,326

(22) PCT Filed: Jul. 31, 2020

(86) PCT No.: PCT/EP2020/071701

§ 371 (c)(1),
(2) Date: Jan. 28, 2022

(87) PCT Pub. No.: WO2021/019087

PCT Pub. Date: Feb. 4, 2021

(65) Prior Publication Data

US 2022/0258207 A1 Aug. 18, 2022

(30) Foreign Application Priority Data

Jul. 31, 2019 (EP) ..... 19189382
Sep. 1, 2019 (EP) ..... 19194810

(51) Int. Cl.
*B07B 1/40* (2006.01)
*B07B 1/42* (2006.01)
(Continued)

(52) U.S. Cl.
CPC ..... *B07B 1/40* (2013.01); *B01F 27/1141* (2022.01); *B01F 27/1151* (2022.01);
(Continued)

(58) Field of Classification Search
CPC .. B07B 1/06; B07B 1/42; B07B 1/469; B07B 1/50; B07B 2201/04; B07B 2230/04;
(Continued)

(56) References Cited

U.S. PATENT DOCUMENTS 2,312,829 A * 3/1943 Bird ..... B04B 3/00 210/111
2,950,819 A * 8/1960 Holman ..... B07B 1/38 209/331

(Continued)

FOREIGN PATENT DOCUMENTS

CN 2435159 Y * 8/2000
CN 2435159 Y 6/2001

(Continued)

OTHER PUBLICATIONS

"Sieve," Wikipedia, Jan. 21, 2022, <https://en.wikipedia.org/w/index.php?title=Sieve&oldid=1066969421>.

(Continued)

*Primary Examiner* — Terrell H Matthews
(74) *Attorney, Agent, or Firm* — Oliff PLC

(57) ABSTRACT

A device, which serves to separate particles of a bulk material, which is deliverable at an input location and is removable processed in different or at least approximately unitary particle sizes at an output location, includes at least one separating element, which has a metal separating plate with through-openings provided therein, which separating element can be provided with ultrasonic energy and for this purpose is connected to an ultrasonic transducer and which is held by a holding device. The holding device is a mounting shaft, which is held at one end or at both ends fixedly or movably, in particular rotatably and/or axially displaceable, and which at one end or at both ends is connected to an ultrasonic transducer, by means of which ultrasonic energy is couplable via the mounting shaft into the (Continued)

Figure 1A:
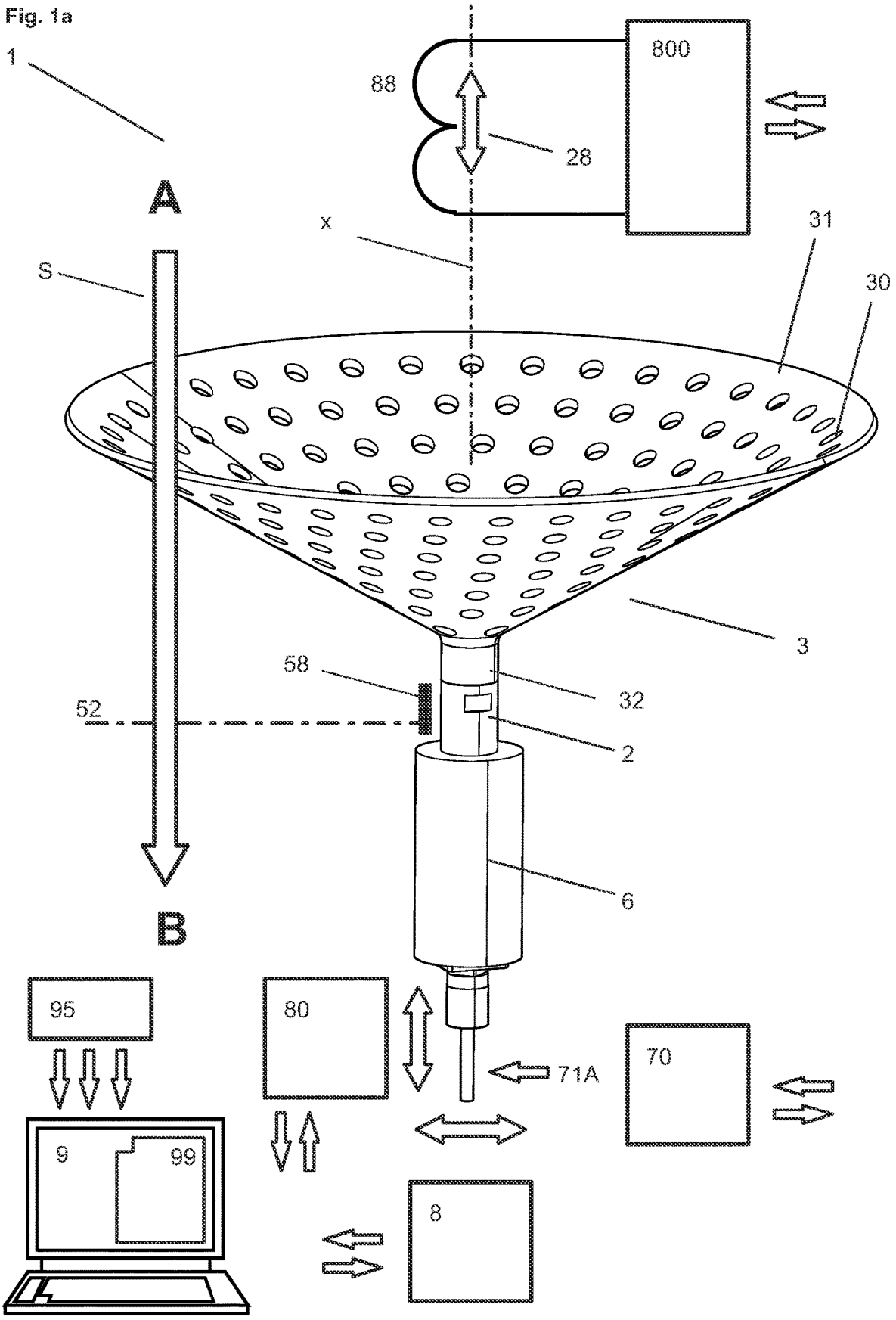

separating element, which is designed to be dimensionally stable.

15 Claims, 10 Drawing Sheets

(51) Int. Cl.

| | |
|---|---|
| ***B07B 1/46*** | (2006.01) |
| ***B01F 27/114*** | (2022.01) |
| ***B01F 27/94*** | (2022.01) |
| ***B01F 31/80*** | (2022.01) |
| ***B01F 27/93*** | (2022.01) |
| ***B01F 27/1151*** | (2022.01) |
| ***B01F 27/191*** | (2022.01) |
| ***B01F 31/44*** | (2022.01) |
| ***B01F 27/117*** | (2022.01) |
| ***B01F 31/40*** | (2022.01) |
| ***B01F 31/441*** | (2022.01) |
| ***B07B 1/06*** | (2006.01) |
| *B07B 1/50* | (2006.01) |

(52) U.S. Cl.
CPC ..... *B01F 27/1171* (2022.01); *B01F 27/191* (2022.01); *B01F 27/93* (2022.01); *B01F 27/941* (2022.01); *B01F 31/40* (2022.01); *B01F 31/441* (2022.01); *B01F 31/449* (2022.01); *B01F 31/83* (2022.01); *B07B 1/06* (2013.01); *B07B 1/42* (2013.01); *B07B 1/469* (2013.01); *B07B 1/50* (2013.01); *B07B 2201/04* (2013.01); *B07B 2230/04* (2013.01)

(58) Field of Classification Search
CPC .. B01F 31/449; B01F 27/1151; B01F 27/191; B01F 27/941
See application file for complete search history.

(56) References Cited

U.S. PATENT DOCUMENTS

| | | | | | |
|---|---|---|---|---|---|
| 3,481,468 | A * | 12/1969 | Tonjes | B06B 1/167 | 74/52 |
| 4,405,454 | A * | 9/1983 | Hultsch | B01D 33/25 | 209/279 |
| 5,149,424 | A * | 9/1992 | Lundquist | B01D 33/725 | 210/174 |
| 5,653,346 | A * | 8/1997 | Frei | B07B 1/42 | 209/254 |
| 2010/0124716 | A1 * | 5/2010 | Tomioka | G03G 9/0819 | 430/137.14 |

FOREIGN PATENT DOCUMENTS

| | | | | |
|---|---|---|---|---|
| CN | 105827059 | A | 8/2016 | |
| DE | 4418175 | A1 * | 12/1994 | B01D 33/0346 |
| DE | 10 2009 015 352 | A1 | 9/2010 | |
| DE | 102009015352 | A1 * | 9/2010 | A61J 3/077 |
| DE | 44 48 017 | B4 | 5/2011 | |
| EP | 0 943 374 | A2 | 9/1999 | |
| EP | 3771500 | A1 * | 2/2021 | B01F 11/0054 |
| JP | 2011245446 | A | 12/2011 | |
| WO | 2018/219840 | A1 | 12/2018 | |

OTHER PUBLICATIONS

Schulze, Dietmar, Pulver and Schüttgüter, Fliesseigenschaften and Handhabung, 3rd Edition, 2014, Springer-Verlag Berlin, pp. 1-7.

Nov. 26, 2020 International Search Report issued in International Patent Application No. PCT/EP2020/071701.

Nov. 26, 2020 Written Opinion of the International Searching Authority issued in International Patent Application No. PCT/EP2020/071701.

* cited by examiner

SEPARATION DEVICE AND METHOD OF OPERATION

The invention relates to a separation device with a holding device by means of which a separating element, preferably a sieve, is held, as well as a method of operation for this separation device.

In numerous industrial sectors, such as the food industry, the chemical industry, the pharmaceutical industry and the construction materials industry, intermediates are often required that are available in particle form, i.e., "atomized" in the form of particles separated from one another. In this form, the intermediate can be precisely dosed and efficiently used. Incorrect dosing, which could cause undesirable taste, solidification, financial or medical problems, is avoided. Bulk material can be required atomized in a uniform particle size or also in different particle sizes.

Separation devices therefore allow particles of a bulk material to be separated from one another and, if necessary, also provide the bulk material in a largely uniform particle size. The bulk material is transported from an input position to an output position where it is to be provided in the desired form. This transport usually takes place under the influence of gravity, mechanical movements and, in screening technology, possibly also under the supply of ultrasonic energy.

According to https://en.wikipedia.org/wiki/Sieve, separation devices in the embodiment of a sieve device comprise a sieve lining which contains a large number of openings of the same size as the separation medium. The size of the openings is referred to as the mesh size. Larger grains remain above the openings (sieve overflow), smaller grains fall through (sieve passage). A grain that is approximately the same size as the mesh size is called a limit grain. A sieve can consist of one or more superimposed sieve layers, with the sieve layer with the largest mesh size at the top of the sieve stack. The cleanliness of the screen lining is important for the efficiency of a screen. In particular, the clogging of the sieve openings by boundary grain must be prevented by suitable measures (e.g., by brushes, balls, chains, rubber cubes which "run" on or under the sieve or by increasing the hole diameter downwards, e.g., in the case of conically or double-cylindrically drilled holes).

In large-scale applications, screen linings are excited by a drive to perform specific movements in order to improve screening performance. The movement of the screen lining serves to transport the feed material further in the longitudinal direction of the screen, to eject the boundary grains from the mesh openings and to improve the sustainability of the separation (screening efficiency).

Known are tumbler screening machines (see e.g. the EP0943374A2), which have a screen structure that can be brought into a tumbler motion (throwing and oscillating motion), a supporting device that elastically supports the screen structure and a mounting shaft driven in rotation by an electric motor, which drives a sliding pin adjustable in its inclination and eccentricity, on which the screen structure is mounted. The mounting shaft and the sliding pin thus set the screen lining in a predetermined and constant motion. Such systems are complex in design and cause considerable building vibrations and noise and require a relatively high level of maintenance.

During transport, storage, mixing, segregation, dosing and handling of powders and bulk materials, their flow properties play an important role. When screening the bulk material, it is important that its particles can be separated and pass through the screen openings.

WO2018219840A1 describes a screening device with a support device, by which a screen is held, which comprises a screen lining, held by a screen frame, which is connected to a drive device. The drive device, which is controlled by a control unit, comprises at least three actuators, which on the one hand are each connected to the support device via a first rotary joint and on the other hand are each connected to the screen frame via a second rotary joint, so that the screen is held solely by the actuators and is displaceable and optionally rotatable within a working volume. The screen lining is also preferably subjected to ultrasonic energy so that the screening process is accelerated. This separation device, which delivers very good results, is also complex and requires a relatively large amount of space. Feeding the bulk material through a conveying container, on the other hand, is not easy or can only be realized with great effort.

JP2011245446A discloses a screening with a screen lining, which is held by an outer frame and against which a metallic diaphragm rests, via which ultrasonic energy is transmitted from an ultrasonic source to the screen lining. Under the influence of the ultrasonic energy, particles of the bulk material whose diameter is smaller than the mesh size of the screen lining can pass through the screen lining more quickly as a screen passage. Particles of the bulk material whose diameter is larger than the mesh size of the screen lining are carried away to the outside via the outer frame as screen overflow. This separation device with a screen lining and an adjacent diaphragm is also relatively complex.

DE4448017B4 discloses a device for screening, classifying, sifting, filtering or sorting dry solid materials or solid materials in liquids, with a screening surface provided in a screen frame and an ultrasonic transducer associated therewith, by means of which vibrations can be applied to the screening surface. Associated with the ultrasonic transducer is at least one resonator which is in contact with the screen surface and which is tuned to the resonance of the ultrasonic transducer and can be caused to vibrate by the latter. If the screen is to be subjected to mechanical vibrations, it is installed, for example, in a vibrating screening machine. The installation in a vibrating screening machine causes correspondingly high expenses. Furthermore, the mechanical movements that can be exerted on the screen by the vibrating screening machine are limited in the forms of movement and are only slowly effective.

Dietmar Schulze, Pulver and Schüttgüter, Fliesseigenschaften and Handhabung, 3. Edition, Springer-Verlag Berlin 2014, chapter 1, describes common problems with bulk materials. If the outlet opening is too small, a stable vault (bridge) can form, causing the bulk material flow to stop. Another problem can be core flow, which occurs when the hopper walls are not steep or smooth enough. In this case, the bulk material in the filled silo cannot slide directly down the hopper walls. Dead zones are formed, which may be asymmetrical and where the bulk material can no longer flow out due to gravity alone. Core flow can also cause parts of the product to have extremely short residence times, so that freshly filled product is immediately drawn off again and cannot be intermediately treated and vented in the silo. The problems described result on the one hand from equipment conditions and on the other hand from the properties of the bulk material (strength, friction). When designing silos, feed hoppers, bins, etc., or when optimizing powders and bulk materials, the behaviour of the bulk material must first be determined. This then leads to a geometric shape (hopper, outlet size) through the application of well-founded design methods.

Known devices are therefore regularly bound to the processing of a certain type of bulk material, which is why the flexible use of these devices is not possible.

The present invention is therefore based on the object of providing an improved device for separating particles of a bulk material, which allows particles of the bulk material to be separated from each other using ultrasonic energy.

By means of the inventive device, a better distribution of the bulk material on the separating element, such as a separating plate, is to be achieved more quickly by simple means.

It shall be possible to provide the particles of the bulk material in different or similar particle sizes or in an at least approximately uniform particle size.

Furthermore, a method of operation for this improved separation device shall be specified, by means of which various processes, such as processes for loading, separating, mixing, aerating, deaerating, unloading the bulk material, can be advantageously carried out. Furthermore, processes for the cleaning and maintenance of the separation device shall be advantageously feasible.

The separation device shall have a simple and compact design and shall be easy to maintain. The separation device shall have a high efficiency and a correspondingly reduced energy consumption. Vibrations and shocks, as they occur with known separation devices, shall be avoided or significantly reduced without reducing the efficiency of the separation device.

It shall be possible to process the bulk material within the shortest possible path length between an input location and an output location in order to avoid voluminous installations.

The processed bulk material shall be provided in high quality with a high degree of separation, so that incorrect dosing during the application of the processed bulk material can be avoided.

During the processing of the bulk material, it shall be possible to carry out further processes in a simple manner. In particular, the removal of the bulk material in a certain processing state shall be possible in a simple manner. Furthermore, at least one further material shall advantageously be admixable to the bulk material, after which the mixed product is also provided in the desired particle shape.

The processing of the bulk material shall be advantageously possible under increased or reduced pressure of air or a liquid.

The separation device as well as the feed channels and/or discharge channels shall be designed to be largely independent of the type of bulk material and shall be realized with small dimensions. Residues of bulk material and corresponding changes in the cross-section of the transport paths, in particular dead zones, shall be avoided during operation of the separation device.

The method of operation shall allow setting of optimum working parameters for the separation device, so that the currently processed bulk material present can be optimally separated.

This task is solved with a separation device and a method of operation, which have the features specified in claims 1 and 14, respectively.

Advantageous embodiments of the invention are specified in further claims.

The device, which serves to separate particles of a bulk material, which is deliverable at an input location and is removable processed in different or at least approximately unitary particle sizes at an output location, comprises at least one separating element, which has a metal separating plate with through-openings provided therein, which separating element can be provided with ultrasonic energy and for this purpose is connected to an ultrasonic transducer and which is held by a holding device.

According to the invention, the holding device is a mounting shaft, which is held at one end or at both ends fixedly or movably, in particular rotatably and/or axially displaceable, and which at one end or at both ends is connected to an ultrasonic transducer, by means of which ultrasonic energy is couplable via the mounting shaft into the separating element, which is designed to be dimensionally stable.

For the transmission of electrical energy, in particular an alternating voltage from an ultrasonic generator to the ultrasonic transducer, the mounting shaft is preferably provided with a contacting device. The contacting device preferably comprises slip rings and sliding contacts connected thereto, via which AC voltage signals and/or DC voltage signals, possibly control signals, can be transmitted to the ultrasonic transducer or a control device possibly provided there and/or an ultrasonic transducer connected to the mounting shaft, which in turn feeds the ultrasonic transducer.

The ultrasonic transducer preferably has a piezoelectric transducer, which preferably comprises several piezoelectric elements. The piezoelectric elements are preferably clamped between two metal plates, which are positively or non-positively connected or welded to the mounting shaft and are connected to the ultrasonic generator jointly or individually by connection contacts. Vibrations of the piezoelectric elements are transmitted via the metal plates to the mounting shaft and further to the at least one separating element. The metal plates can be arranged as screw nuts each on a thread at the mounting shaft. By Lightening the nuts, the piezoelectric elements are braced and at the same time an optimal connection between nuts and mounting shaft results. It is also advantageous to use only one screw nut, by means of which the piezo elements can be pressed against a metal plate firmly connected to the mounting shaft.

The mounting shaft can be made from one or more pieces. The mounting shaft is connected in one piece or by a coupling to the motor shaft of the drive motor.

In a preferred embodiment, the piezoelectric elements are ring-shaped so that they can enclose the mounting shaft. This design yields a compact structure with maximum effect. Preferably, five to twenty piezoelectric elements are provided. The piezoelectric elements are preferably separated from each other by contact elements and, if necessary, insulation plates.

By means of alternating voltages in the ultrasonic range, the piezo elements can be excited to vibrations which are transmitted to the at least one separating element. The ultrasonic vibrations cause the particles of the bulk material to be detached from each other and to pass through the separating element if they have a correspondingly small diameter. Furthermore, a firm contact between the separating element and the bulk material is prevented. The static friction and/or sliding friction and thus the frictional forces that result between the separating element and the bulk material are thus substantially reduced, so that the bulk material is kept flowing and not blocked.

By means of the inventive separating element, any kind of bulk material, homogeneous bulk material or non-homogeneous bulk material, as well as bulk material with any particle size can be processed. Within the separation device the bulk material can be subjected to processes in which it is thermally treated and/or ventilated and/or cleaned and/or changed in composition.

The separating plate can have a grid structure or wire mesh structure, which is connected to the mounting shaft by at least one mounting element, such as a connecting sleeve or by at least two connecting rods, which have the same or different diameters. The separating plate may for example be enclosed by a ring, which is connected by the connecting rods to the mounting shaft or to a mounting sleeve enclosing the mounting shaft.

By using a dimensionally stable separating element and connecting it to an elongated, for example rod-shaped or cylindrical mounting shaft made of metal, into which ultrasonic energy can be coupled, a separation device with numerous advantages results.

Since the separating element is held by a preferably centrally arranged mounting shaft and is dimensionally stable, larger mounting devices, in particular separating elements with mounting frames, are no longer required. At the same time, the bulk material can be acted upon more directly and flexibly. The bulk material can optionally be subjected to any mechanical and acoustic influences in order to optimize the separation process. The separation process can also be carried out more efficiently with reduced energy consumption. Via the mounting shaft, at least one separating element or at least one separating plate can be subjected to any axial and rotational movements as well as to any ultrasonic waves. If the bearing devices by means of which the mounting shaft is held are also rotatably mounted, further rotary movements can be performed.

As the at least one separating element is not held peripherally but centrally by the mounting shaft, the separation device becomes more flexible. By avoiding connecting elements by means of which the separating element is peripherally connected e.g., with a housing, with holders or further mounting elements, the parts which are now independent of the separating element can be realized with higher degrees of freedom.

Due to the increased flexibility of the device, the characteristics of the separating device can be largely determined by the operating parameters of the control device, and therefore the design of the separating device requires less attention and effort. The separating plate can for example protrude peripherally between flanges, forming a closure for example against a housing and ensuring that bulk material can only pass through the separating element. In principle, the mounting of the mounting shaft can also be supported or replaced by the mounting of the separating element.

The separation device can be adapted with simple measures or the selection of operating parameters to a bulk material and the goals specified by the user. Thus, the inventive separation device can optimally process different types of bulk material. For example, chemical powders, food particles, crystals, small mechanical parts and the like can be processed with the same separation device. If, on the other hand, the same bulk material is always processed, it is advisable to provide separation devices with correspondingly adapted dimensions.

The dimensions of the separation device and the separation elements can therefore differ by orders of magnitude. Likewise, the operating parameters, in particular rotational speeds of rotatably mounted separation elements and switching frequencies, can differ by orders of magnitude.

The separation device, including the feed channels and/or discharge channels, can be designed largely independently of the type of bulk material with regard to the possibility of setting substantially different operating parameters. The effort required to manufacture the separation devices is thereby advantageously shifted from the design level to the software level. The separation device has a simple but very flexible design, which allows the realization of new processes for the treatment of the bulk material.

The bulk material can be processed within a short path length between the input location and the output location, so that separating devices according to the invention, which are intended for the processing of bulk material in the mentioned industrial sectors, can generally be realized with reduced dimensions.

Due to the advantageous possibilities for acting on the bulk material, the separation of the particles can be carried out more efficiently not only in the area of the separating element or elements, but over the entire transport path of the bulk material. Due to the increased flexibility of the separation device and the more advantageous action on the bulk material, residues with changes in the cross-section of the transport paths, in particular dead zones, are advantageously avoided. Optimal operation of the separation device can therefore be maintained over a longer period of time and the effort required for maintenance of the separation device is significantly reduced. The flexibilization of the separation device also enables at least partial self-cleaning of the device. For this purpose, the separation devices can be moved at the required speeds, for example to remove a screen overflow. In preferred embodiments, cleaning agents can be injected or sprayed (see FIG. 4*a*), for example via the same channels, to influence the working processes.

The increased flexibility of the separation device thus enables not only the optimum realization of the separation process, but also the realization of further processes, in particular mixing processes and cleaning processes. During the processing of the bulk material, for example, additional materials, substances and media can be easily added at any point or at any separation element and/or intermediately processed bulk material can be removed.

The bulk material can also be processed in a closed chamber under any gas pressure, vacuum if necessary.

Due to the advantageous direct action on the bulk material, the energy requirement can be reduced. Vibrations and shocks, as they occur with known separation devices, are significantly reduced. With reduced energy, the bulk material can be acted on more directly and thus more intensively. Vibrations of the separation device, which could lead to vibrations of the building, are advantageously avoided.

The processed bulk material can be provided in high quality with a high degree of separation, so that incorrect dosing during the application of the processed bulk material is avoided. As mentioned, qualitative changes of the bulk material can be made advantageously in the working processes. A mixed material is integrated into the bulk material in an optimally distributed manner.

The separating element or the separating plate preferably forms a rotational body.

In preferred embodiments, the separating plate has a basic structure and is, for example, flat, conical, helical, spiral, corrugated, wave shaped, sawtooth-shaped or provided with steps or bends. In a particularly preferred embodiment, the separating plate is spherical-wave shaped. In this design, the ultrasonic waves can propagate particularly advantageously over the surface of the separating plate.

At least one of the separation plates can also be provided with an additional three-dimensional surface structure, which is superimposed on the basic structure and which engages with the bulk material and can move it. Preferably, a surface structure is used in the form of radially or inclined depressions or protrusions, which are arranged at regular or irregular intervals. The separating plate can therefore have a first basic structure that favours the uniform propagation of the ultrasonic waves and that may be overlaid by a surface structure that serves for mechanical interaction with the bulk material.

The separating plate can have a uniform thickness or taper gradually or continuously from the center to the periphery, for example in the manner of a blade. In the thinned periphery, oscillations with greater amplitude can develop. Otherwise, the dimensions of the separating plate are chosen depending on the required strength of the bulk material and the diameter of the separating plate. At the point where the separating plate is connected to the mounting shaft, the material thickness can be in the range of 1 mm to 50 mm. If the separating plate tapers outwards, the material thickness there can be reduced by a factor of 10 to 100. The diameters of the separating plates can be in the range of 10 mm to 1000 mm or more. Again, the properties, in particular the specific weight of the bulk material, are decisive.

Preferably, separator plates made of metal that conducts ultrasound, such as aluminium, steel, in particular stainless steel, copper, brass, titanium or an alloy, for example, with such metals are used. It is also advantageous to use separator plates which are provided with a resistant protective layer, such as a precious metal layer.

The separating plate is manufactured, for example, by primary forming from granular, powdered or liquefied material; by forming, such as rolling, forging, bending, pressing or deep drawing; by thermal erosion, such as spark erosion, die sinking, laser cutting; or by machining, for example by turning, drilling, milling, grinding.

The through-openings in the separation plates can also be realized by the processes mentioned. The diameter of the through-openings is for example in the range of 1 micron-1000 microns for powdery bulk material. For bulk material with larger mechanical particles the diameter of the through-openings can be in the range of for example 1 mm-15 mm. The diameter of the through-openings of all separating elements can be the same or can change gradually, so that the first passing separating plate has the largest through-openings and the last passing separating plate has the smallest through-openings.

In preferred embodiments, the separating element has a central axis and is rotationally symmetrical with respect to this central axis. The mounting shaft is preferably coaxial or only slightly eccentric to the central axis of the separating element. If the mounting shaft is eccentric to the central axis, oscillations and vibrations result, which facilitate the separation process. Preferably, the separating plates are arranged rotatable or displaceable, so that they can be rotated or displaced and fixed from a coaxial position to an eccentric position. It is particularly advantageous that the at least one separating element in this arrangement can be selectively rotated in one or the other direction at a desired switching frequency and preferably selectively accelerated.

The separating element can be connected to the mounting shaft in various ways. For example, the separating plate comprises a mounting element in the form of a connecting sleeve or at least two connecting rods, which preferably have different diameters. For example, four connecting rods with different diameters are provided crosswise. By using such connecting rods, the coupling can be carried out in an advantageous, in particular circularly rotating manner. Standing waves are avoided or reduced. Instead, different waves are superimposed, whereby the entire surface of the separating plate is activated.

The one-piece or multi-piece mounting shaft made of metal is elongated and preferably rod-shaped or cylindrical. Preferably, the mounting shaft has several interconnectable shaft elements, each of which is fixedly or rotatably and optionally detachably connected to an associated separating element. The individual shaft elements are preferably positively connectable to each other, screwed together or welded together. If the individual shaft elements are detachable from each other, the separation device can be configured as desired and adapted to a specific bulk material.

In particularly preferred embodiments, the one-piece or multi-piece mounting shaft is connected at one end or at both ends to a drive motor. By means of the drive motor or the drive motors, the mounting shaft or the shaft elements can be driven individually in one or the other direction or alternately in one and the other direction about their longitudinal axis.

The mounting shaft is fixed or rotatably mounted at one end or at both ends in a bearing device and is preferably connected by radially aligned connecting bodies to a mounting body, possibly a conveying container.

For the realization of different working processes, the mounting shaft with the at least one separating element is preferably arranged in a conveying container in which the bulk material is trapped and in which different conditions, such as a gas overpressure or a gas underpressure or a vacuum, a spray mist or the like and thus different treatment processes can be realized.

For this purpose, the conveying container is provided with an open or optionally closable through channel through which the bulk material can be transported from the input location to the output location.

Preferably, the conveying container has an outlet opening for at least one of the separating elements, through which bulk material components, such as processed or separated bulk material components or an overflow, can be discharged. Preferably, the outlet openings can optionally be closed.

In a further preferred embodiment, the conveying container preferably has an inlet channel and/or an outlet channel for each of the separating elements, which are realized, for example, by tubular elements.

In preferred embodiments, a power supply device, which is connected to the drive motor or drive motors and optionally to one or more ultrasonic transducers, and a control unit with a control program are provided, by means of which the process for separating the particles of the bulk material and optionally further processes, such as cleaning processes or maintenance processes, can be controlled. By setting the parameters, different process phases can be realized. In a mixing phase the bulk material can be roughly distributed by continuous or alternating rotation of the at least one separating element over a few revolutions or a larger fraction of a revolution, for example 45°-180°. In a working phase, the bulk material can be subjected to a mechanical vibration by alternate rotation of the at least one separating element over a small fraction of a revolution of for example 0.5°-5°, which separates the particles from each other and allows them to pass through the through-openings of the separating elements. In a discharge phase, remaining bulk material or screen overflow can be thrown outward and removed by rotating the at least one separating element at high speed.

The parameters can change over a wide range and depend not at last also on the ultrasonic energy that is coupled into the separating elements.

The rotation speeds can be in the range of one to several thousand revolutions and depend essentially on the size, shape and specific weight of the particles of the bulk material and the design of the separating elements. The magnitude of the accelerations is also particularly important. High accelerations over a fraction of a revolution, for example in the range of 5° to 180°, cause the layers of the bulk material to be displaced and mixed in the mixing phase. This effect can be increased by incorporating surface structures in the separation plates.

In the working phase, the bulk material is already relatively well mixed and at least partially separated on the separating elements. In this phase, the complete separation of the bulk material particles from each other and the conveying through the through-openings of the separating elements takes place. For this purpose, the mounting shaft is moved back and forth over small rotation ranges in the range of, for example, 0.5°-5° with a switching frequency that is preferably in the range of 10 Hz-1000 Hz or more. In the working phase, the separators are therefore subjected to mechanical vibrations in the range of 10 Hz-1000 Hz and ultrasonic vibrations in the range of typically 10 kHz-40 kHz. Preferably, the switching frequency for the mechanical vibrations is changed continuously or abruptly during the working phase. Preferably, the frequency of the ultrasonic vibrations is also changed continuously or abruptly. For example, the frequencies of the switching frequency and of the ultrasonic vibrations are key shifted, i.e., continuously changed between certain, possibly predetermined or randomly selected frequency values. Alternatively, the frequencies of the switching frequency and of the ultrasonic oscillations are changed continuously or are each subjected to a so-called scan, the frequency changes can thereby run against each other or in the same direction. It is also possible that one of the frequencies is rescanned and the other one is scanned.

Sporadic changes from the working phase to the mixing phase are also possible.

In the discharge phase, the separation elements can be freed from bulk material at high speeds, for example in the range of 25 to 1000 revolutions per second. Then, preferably, a cleaning liquid is introduced into the separation device, e.g., sprayed, to clean the separation elements. Finally, a gaseous medium, such as air, can be introduced to dry the separation device. After a discharge phase, the separation device can therefore be transferred by the operating software to a cleaning phase in which the separation device is returned to its initial state. The separation device can therefore be operated with minimal maintenance, particularly with regard to this self-cleaning function.

In preferred embodiments, alternating forces or vibrations can be coupled coaxially into the mounting shaft in the mixing phase and/or the working phase and/or the discharge phase, so that forces can also act on the bulk material particles parallel or anti-parallel to gravity. Such force effects with selectable frequencies can be coupled into the mounting shaft in a simple manner, for example according to the plunger coil principle of acoustic loudspeakers. For example, the mounting shaft is held elastically or vertically displaceable and provided at the bottom or top with an e.g., cylindrical magnet which is immersed in a coil to which an alternating current in the range of 5 Hz-15 kHz is fed. All the above-mentioned effects on the mounting shaft can occur simultaneously or alternately or only sporadically.

The ultrasonic generator is designed to output AC voltage signals preferably in the frequency range of preferably 15 kHz-45 kHz. Preferably, the ultrasonic generator is designed to be able to continuously change and/or to shift the frequency and/or to change the amplitude of the AC voltage signals. The frequency of the output signal, which lies in said frequency range, is preferably changed with a resampling frequency, which lies in the range of 10 Hz-2 kHz. For example, the output signal of the ultrasonic generator is repetitively shifted ten times per second between the ultrasonic frequencies of 25 kHz and 35 kHz with a shift keying frequency of 10 Hz. The repetition frequency can also be used to scan a whole sequence of ultrasonic frequencies of for example 25 kHz, 30 kHz and 35 kHz. Instead of the punctual resampling, a continuous frequency change can also be carried out. For example, a scan between two or more ultrasonic frequencies is performed ten times per second with a change frequency of 10 Hz.

The described changes in the ultrasonic frequencies ensure that no stationary wave nodes occur at the separating plate and that the effect of the ultrasonic signals occurs without gaps.

Figure 1B:
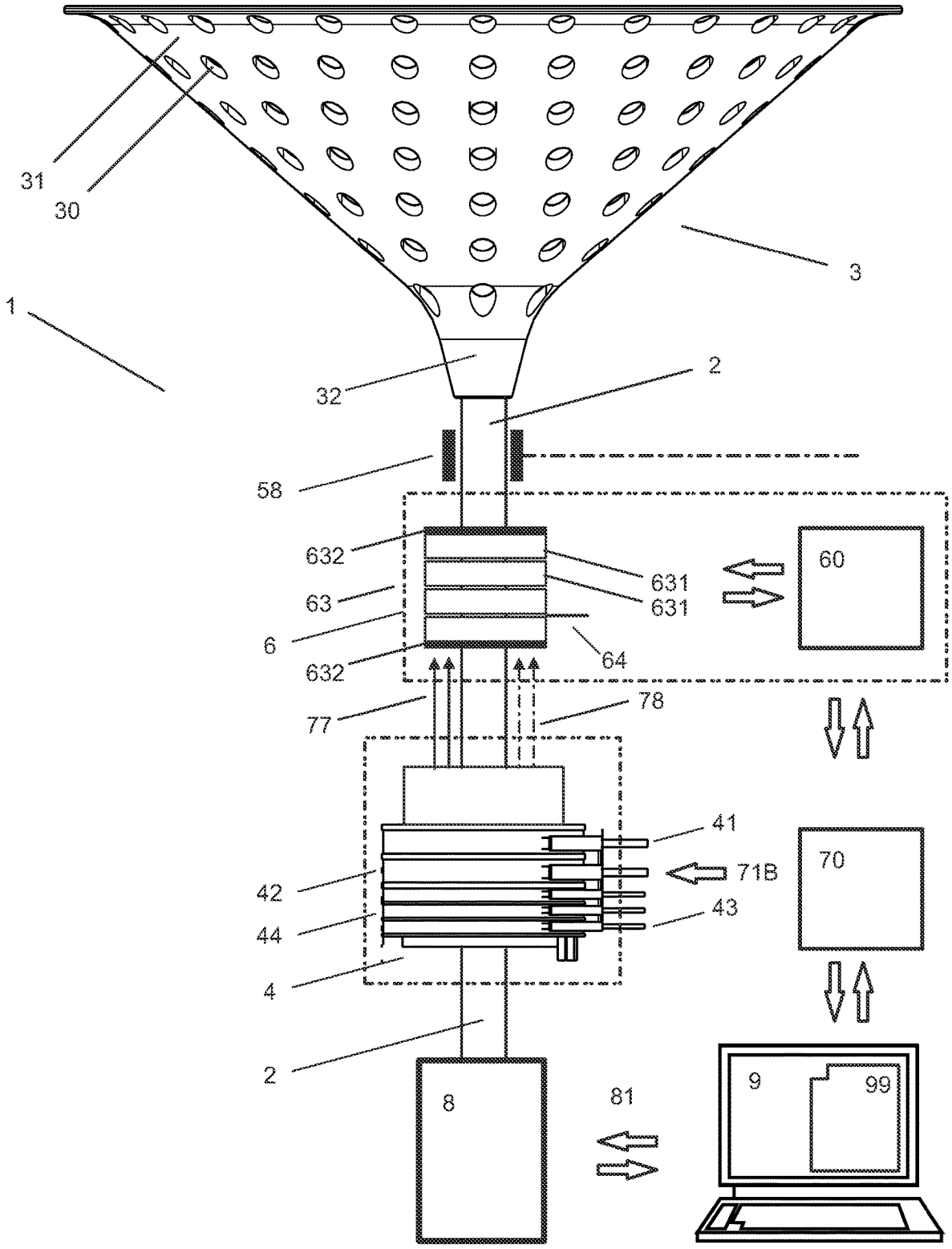
Figure 2:
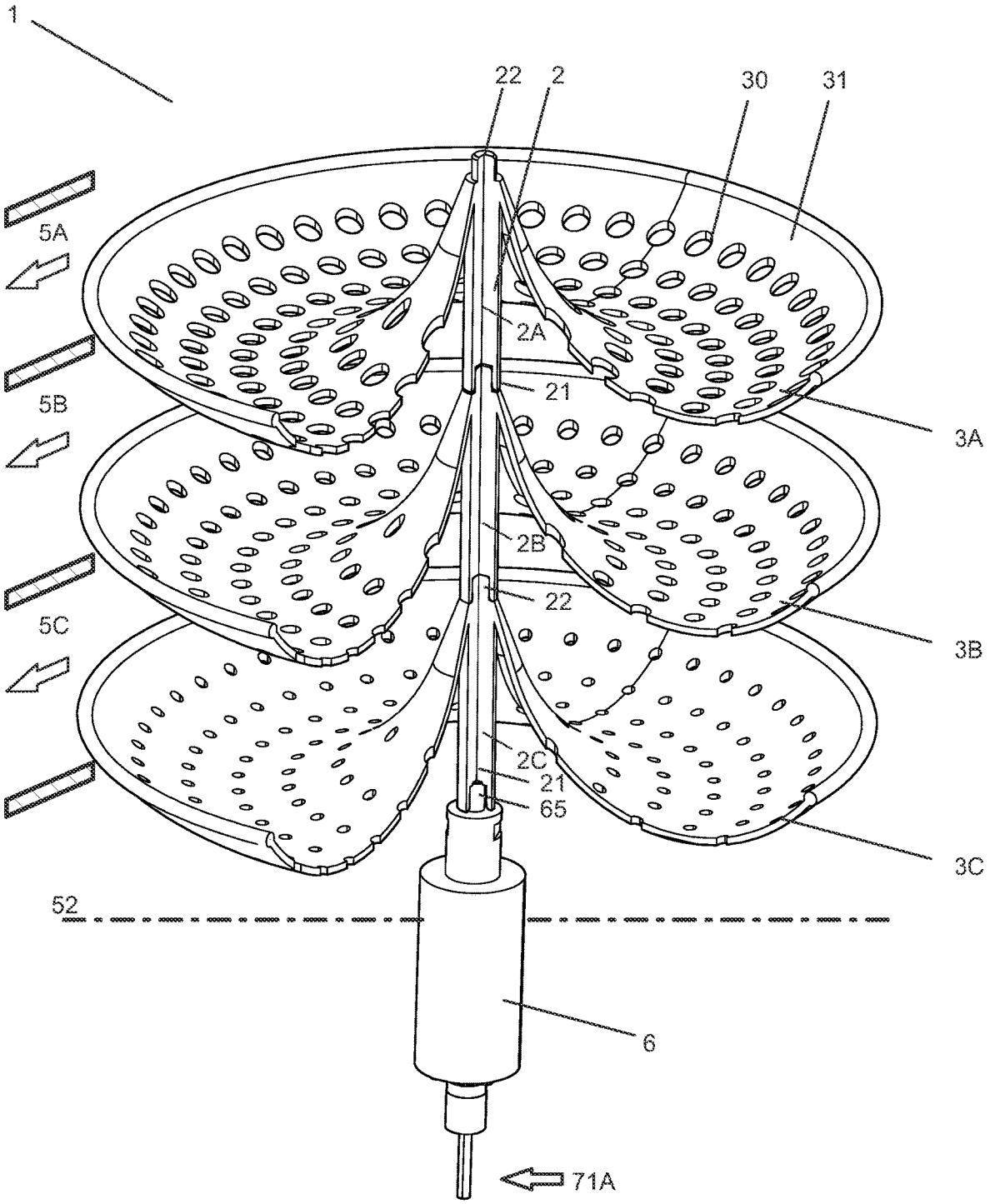
Figure 3:
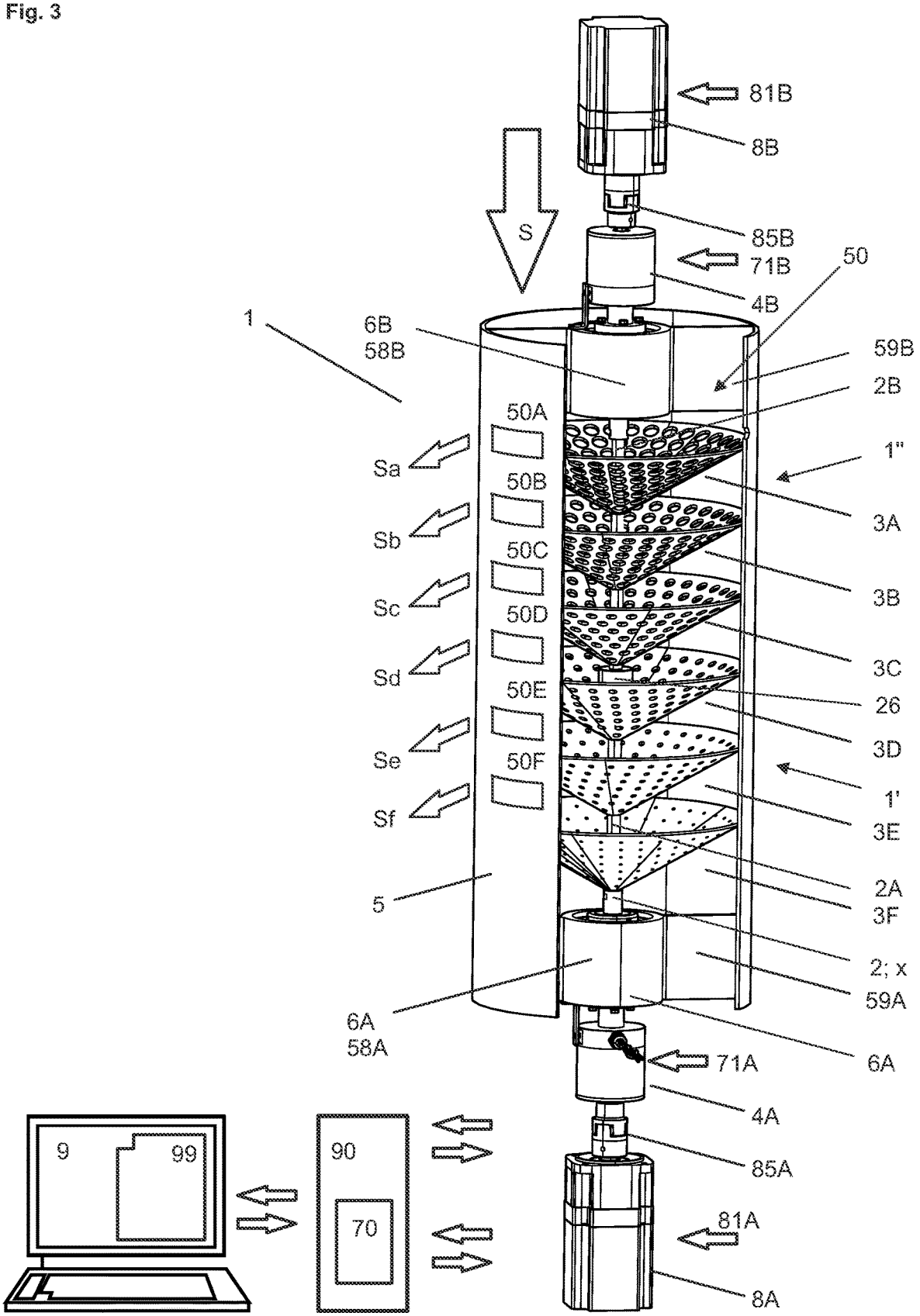
Figure 4A:
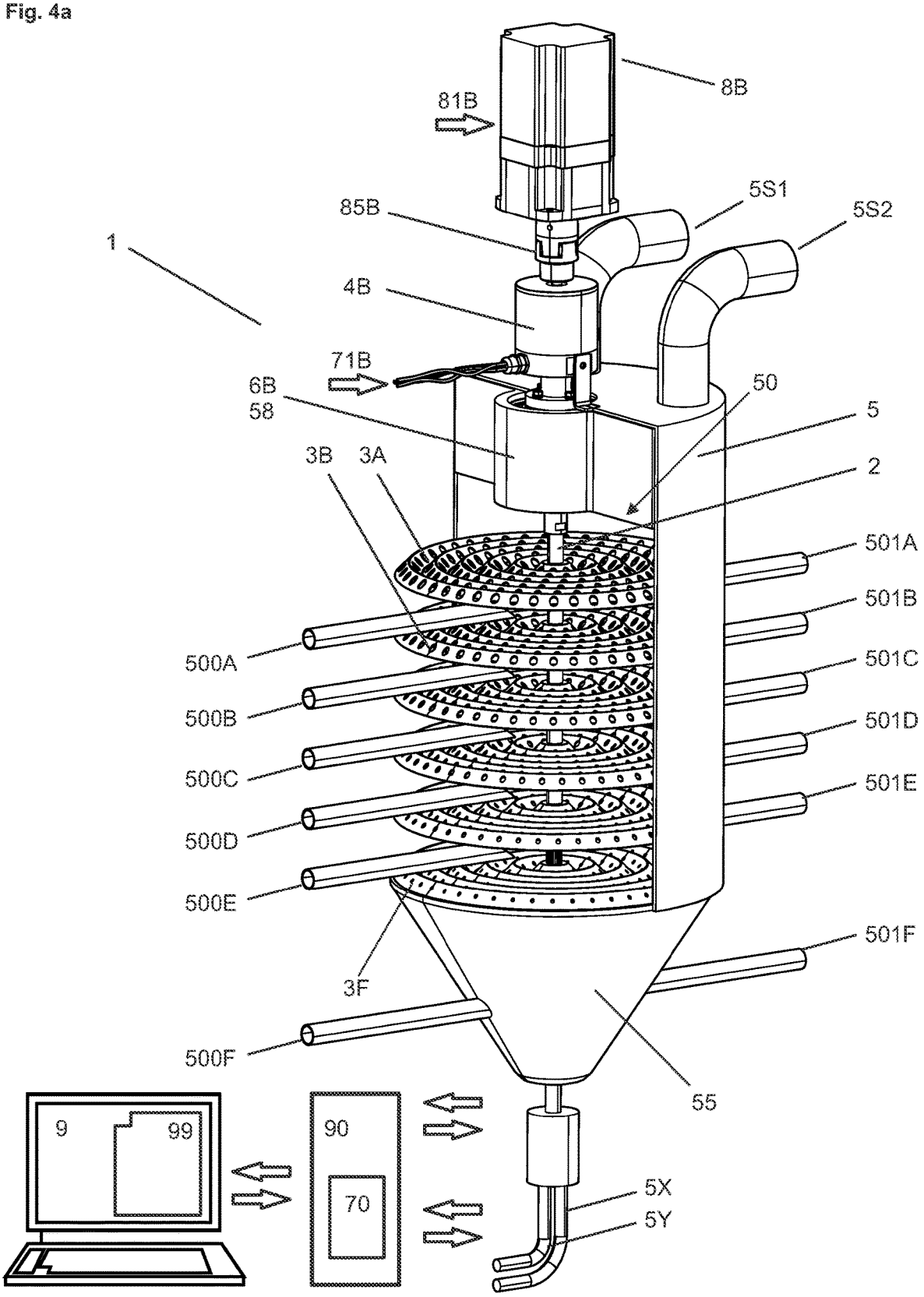
Figure 4B:
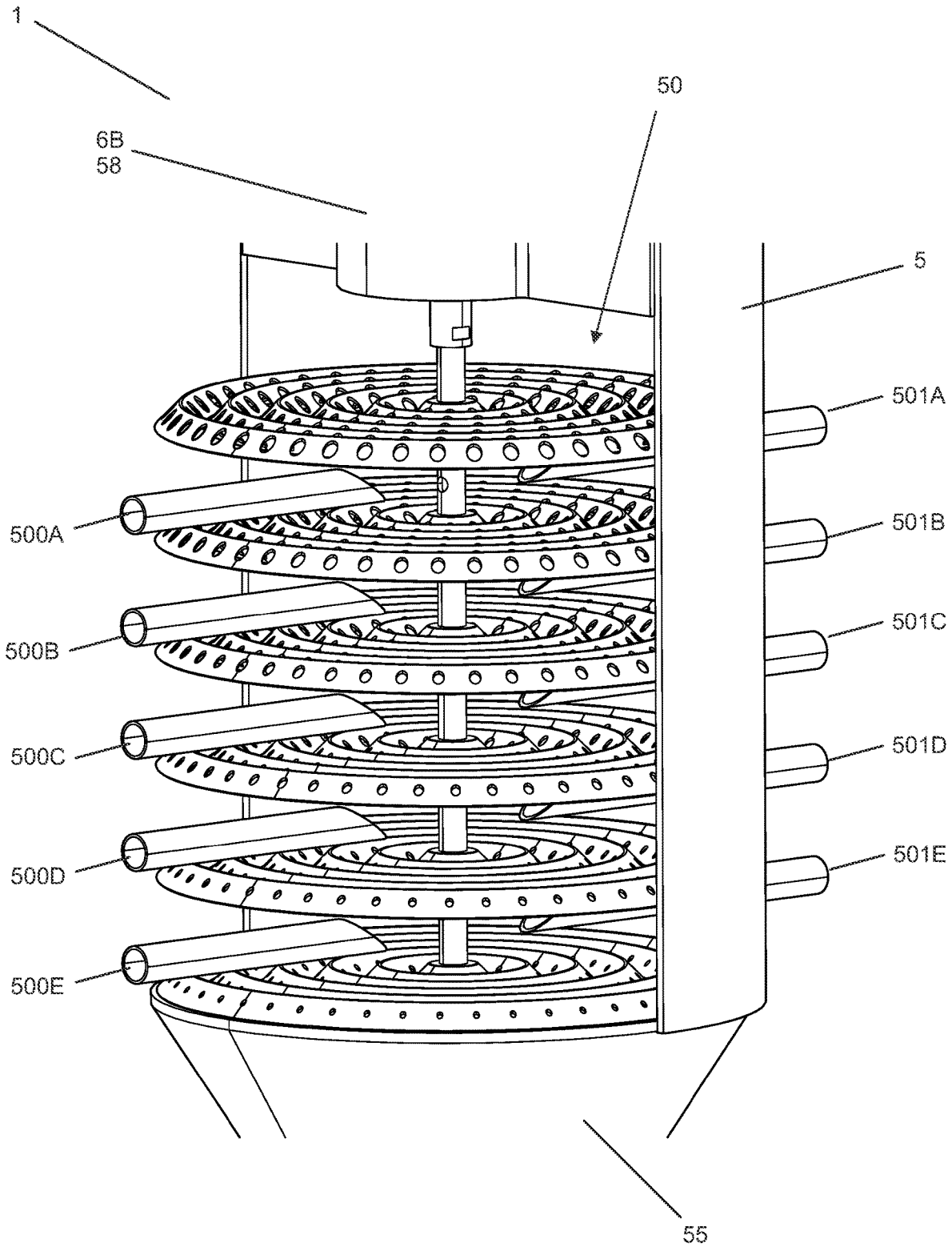

Below, the invention is explained in more detail with reference to drawings. Thereby shows:

FIG. 1*a* an inventive separation device 1 with optional drive devices 8, 80 in a basic embodiment with only one separating element 3, which has a conically shaped separating plate 31 with through-openings 30 and which is held by a fixed or rotatably mounted mounting shaft 2, to which an ultrasonic transducer 6 is connected, which is fed by an ultrasonic generator 70;

FIG. 1*b* the separation device 1 of FIG. 1*a* with an exemplary device for supplying the rotatably mounted separating element 3 with ultrasonic energy;

FIG. 2 an inventive separation device 1 in a quarter section with three separation elements 3A, 3B, 3C, which are held by a fixed or rotatably mounted multi-part mounting shaft 2, to which an ultrasonic transducer 6 is connected;

FIG. 3 an inventive separation device 1 with six separation elements 3A, 3B, 3C, 3D, 3E, 3F arranged in a conveying container 5, which are rotatably held by a multi-part mounting shaft 2 into which ultrasonic energy can be coupled;

FIG. 4*a* an inventive separation device 1 with six separation elements 3A, 3B, . . . , rotatably supported by a mounting shaft 2, which additionally allows supplying material or gases to the processed bulk material and removing processed bulk material at different points;

FIG. 4*b* a part of the separation device 1 of FIG. 4*a;*

Figure 5A:
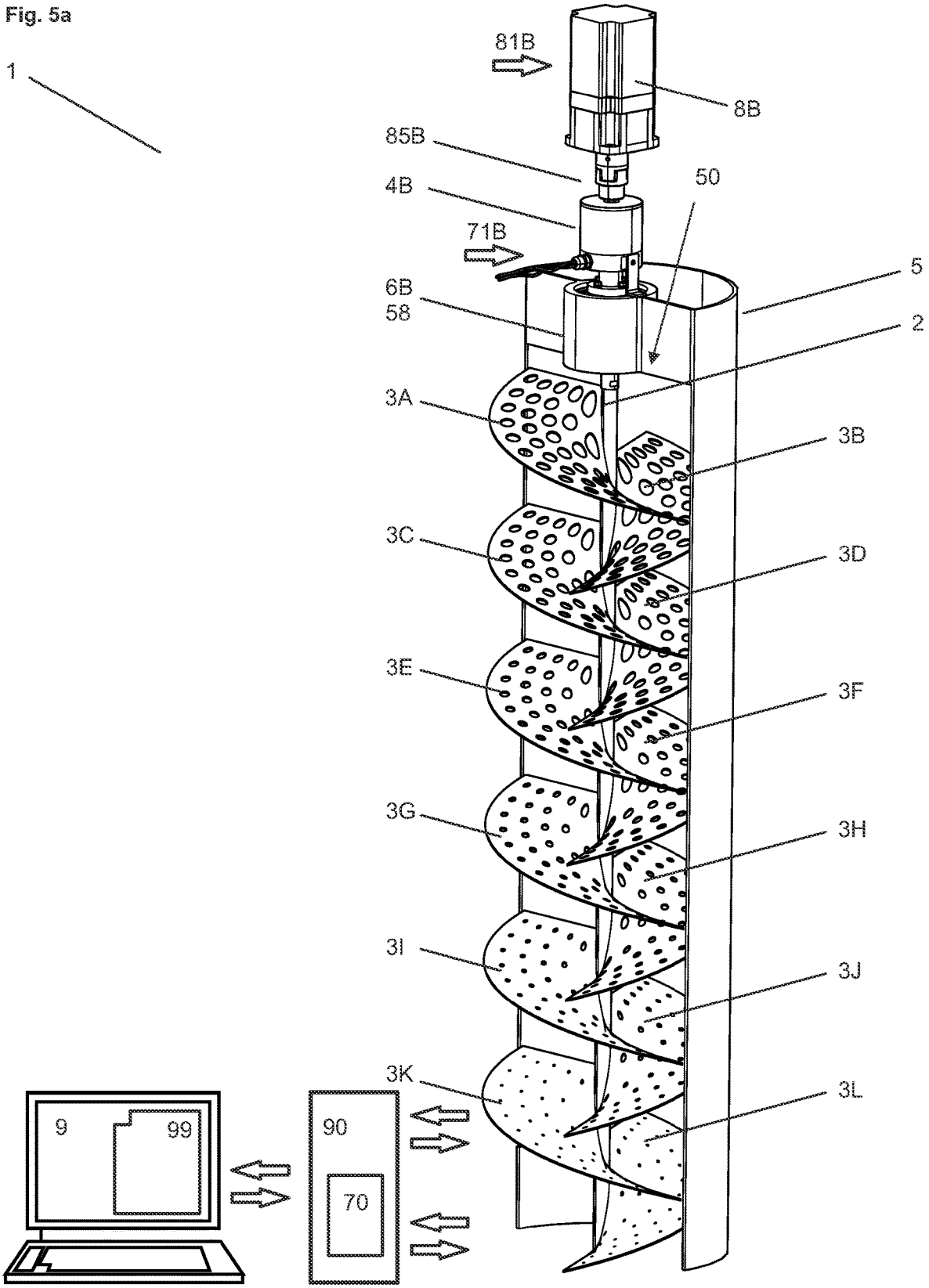
Figure 5B:
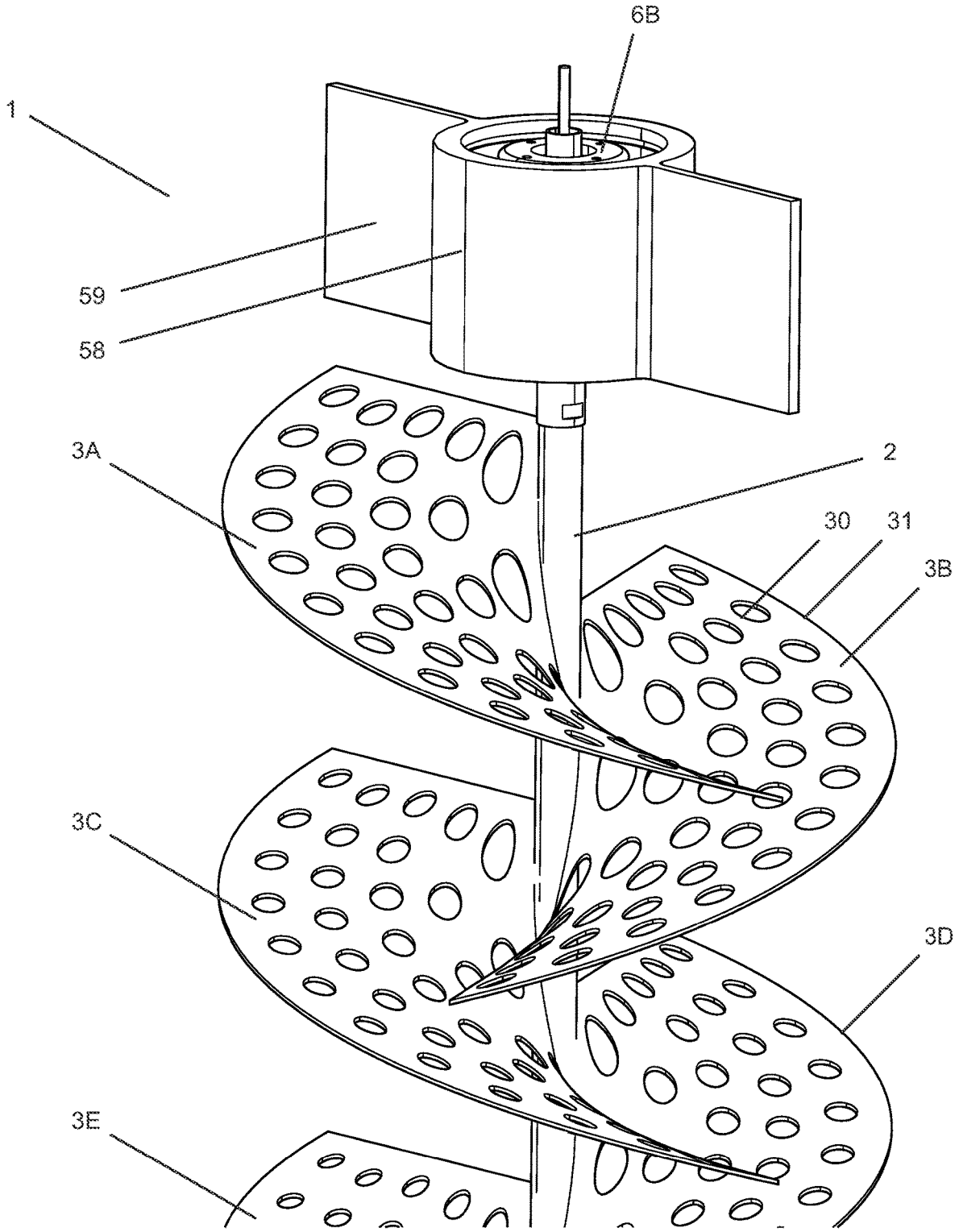

FIG. 5*a* an inventive separation device 1 with helical separating elements 3A, . . . , 3L, which are rotatably mounted by means of the associated mounting shaft 2 and to which ultrasonic energy can be applied;

FIG. 5*b* a part of the separation device 1 of FIG. 5*a;*

Figure 6:
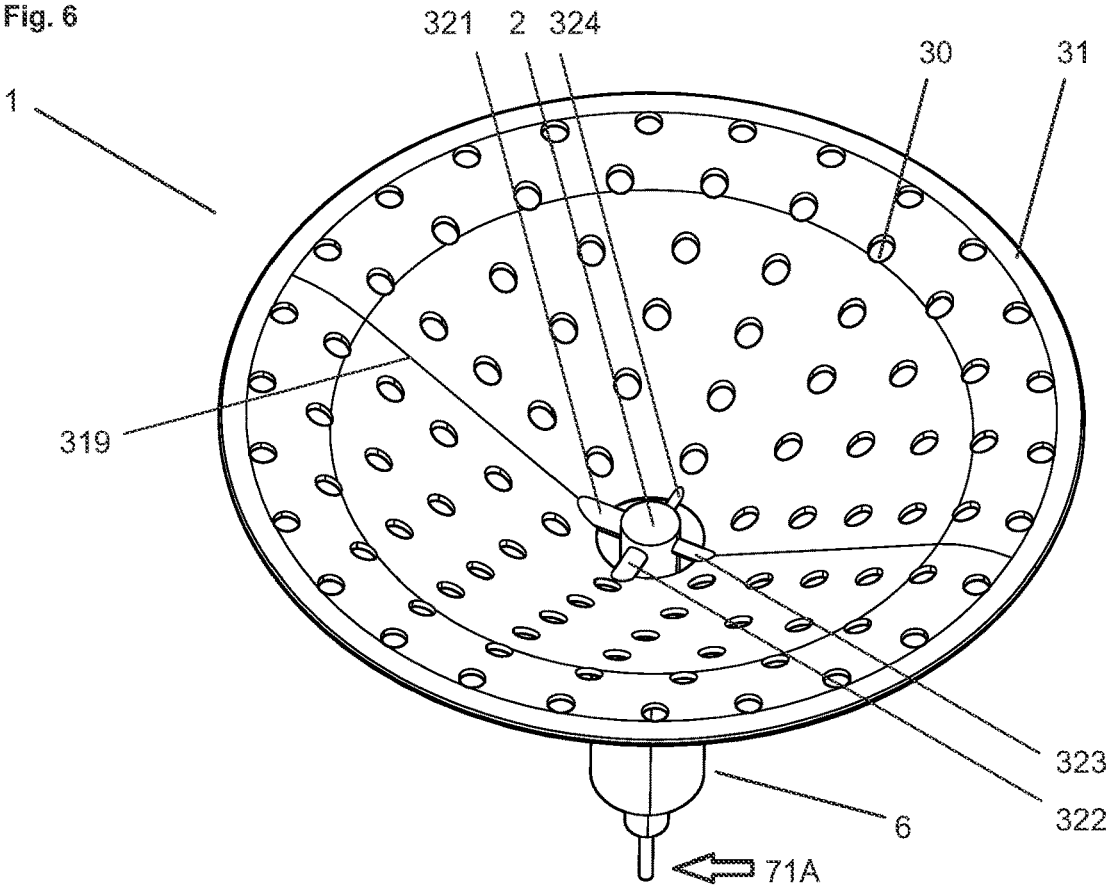
Figure 7:
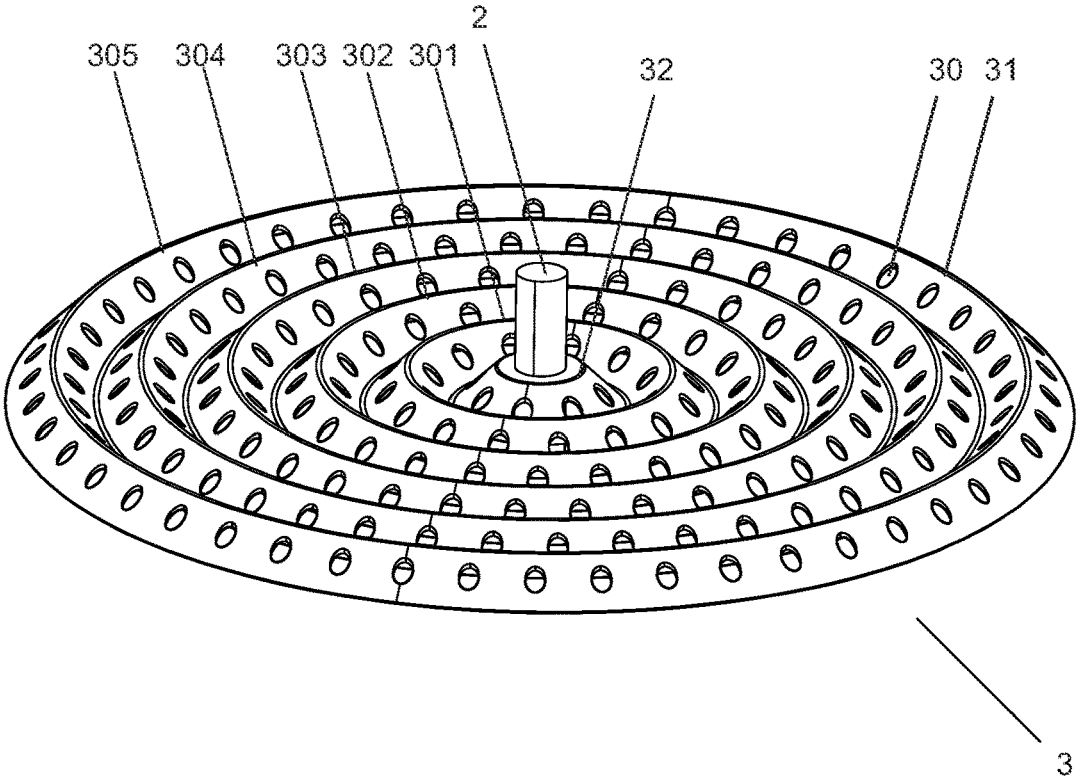
Figure 8:
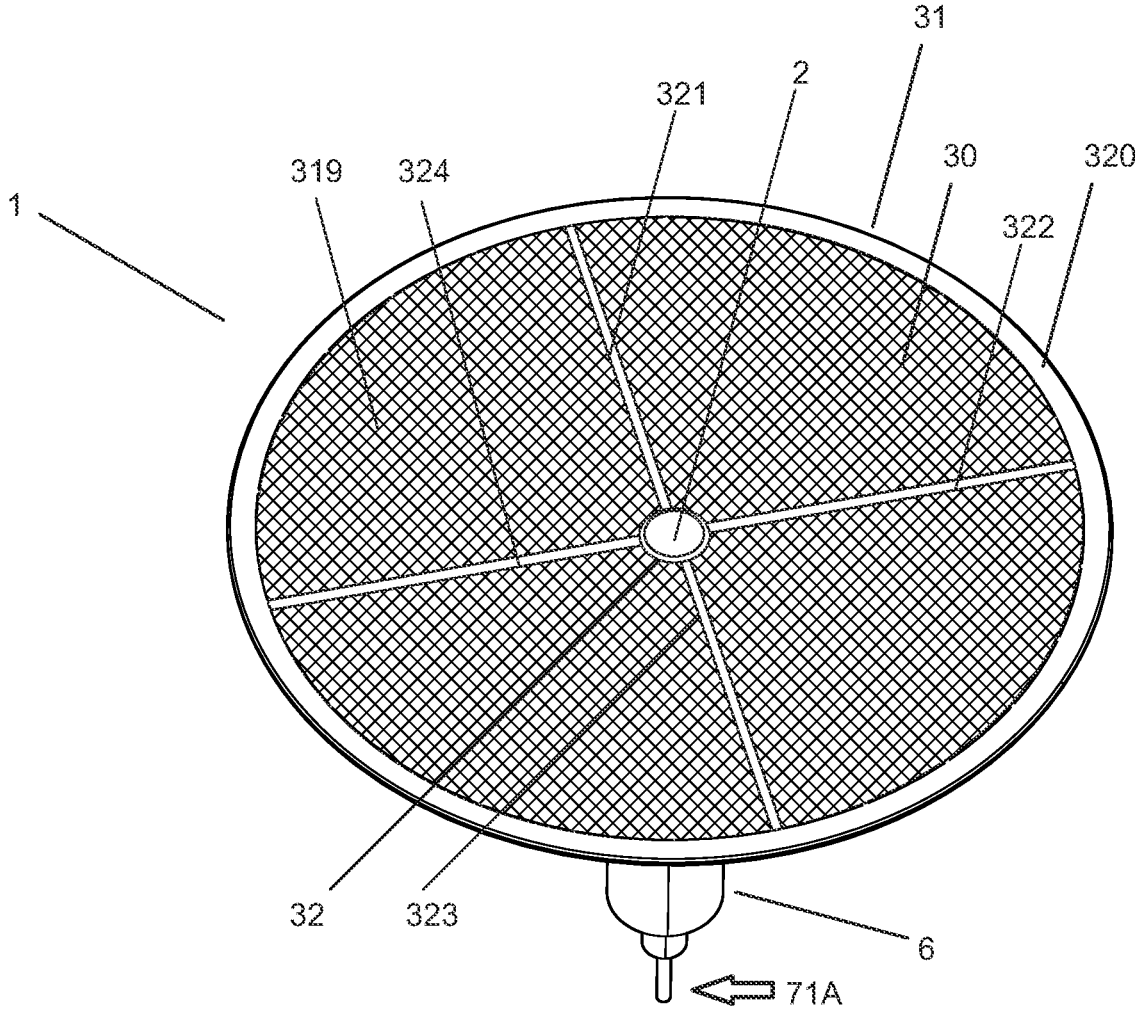

FIG. 6 the separation device of FIG. 2*a* in a preferred design of the separating element 3 with four connecting rods 321, 322, 323, 324 of different thicknesses, by means of which the metal plate 31 is connected to the mounting shaft 2;

FIG. 7 a separating element. 3 with a separating plate 31 in the shape of a spherical wave, as used in the device of FIG. 4; and FIG. 8 a separating element 3 with a separating plate 31, which comprises a grid structure or a wire mesh 319 and which is enclosed by a ring 320, which is connected by connecting rods 321, 322, 323, 324 to the mounting shaft 2 or a mounting element 32, which encloses the mounting shaft 2.

FIG. 1 shows a device 1 according to the invention for separating particles of a process material or bulk material S, which can be supplied at an input location A and, after processing in the separation device 1, can be removed at an output location B in different or similar particle sizes or in an at least approximately uniform particle size.

In this embodiment, the separation device 1 comprises only one separating element 3 with a metal separating plate 31, which forms a body of rotation or a cone, which has through-openings 30 preferably of the same size. The separating element 3 or the conical separating plate 31 has a central mounting element 32, which is held fixed or rotatable and/or axially displaceable by a mounting shaft 2. The mounting shaft 2 is aligned with its longitudinal axis x coaxial to the axis of rotation of the separating element 3, preferably parallel to the axis of gravity. Bulk material is therefore preferably conveyed through the separation device 1 by gravitational force.

This conveying process is preferably supported and accelerated by measures described below. During processing, the separating element 3 is subjected at least intermittently to ultrasonic waves, typically in the frequency range from 15 kHz to 40 kHz. For this purpose, the mounting shaft 2 is connected on the underside to an ultrasonic transducer 6 to which electrical signals 71A from an ultrasonic generator 70 can be fed. The ultrasonic generator 70 is preferably controllable by a control device 9 or the control program 99 implemented therein, so that ultrasonic frequencies can be set and changed as desired.

Furthermore, the separating element 3 can be subjected to mechanical vibrations in a frequency range from a few Hz to for example 1 kHz. As a first option, a drive motor 8 is provided, by means of which the mounting shaft 2 can be rotated in one and/or the other direction. The rotation range, the acceleration and the rotation speed as well as the switching frequency for changing the direction of rotation are again controllable by the control device 9 or the control program 99 implemented therein. A high-frequency vibration motor that can be used in the separation device according to the invention is known, for example, from CN105827059A.

The separation device 1 can further be subjected to a vibratory motion with force effects along the longitudinal axis x of the mounting shaft 2. Such vibrations can easily be generated by motors whose motor shafts are eccentrically loaded. The mounting shaft 2 can be coupled to such a motor 80, which in turn can be controlled by the control device 9 or the control program 99 implemented therein. In turn, any frequencies of vibration can be set in accordance with the speed of the motor 80.

Alternatively, the mounting shaft 2 can be connected to a preferably cylindrical magnet 28, which is arranged within a coil 88, to which an alternating current can be supplied by a frequency generator 800. The switching and disconnection as well as the frequency of the alternating current are in turn controllable by the control device 9 or the control program 99 implemented therein.

In preferred embodiments, the control of the separation device 1 in the mixing phase and/or the working phase and/or the discharging phase is performed taking into account sensor signals emitted by sensors 95. For example, the bulk material lying on the separating element 3 is monitored optically.

The options described for vertical or rotational vibration and for coupling ultrasonic energy from the separating element 3 can be used individually or optionally in combination. The vibration frequencies and/or the vibration amplitudes can be the same or different.

The mounting shaft 2, which serves as a holding device for the separating element 3, is held fixed or rotatable and/or axially displaceable by a mounting device 52 and a bearing device 58 to the extent required by the amplitudes during axial displacement or vibration. In this embodiment, the mounting shaft 2 is held on one side only. Furthermore, the ultrasonic transducer is mounted on the underside of the mounting shaft 2 preferably in a form-fitting and force-fitting manner, preferably screwed, for example clamped by a press fit or welded.

FIG. 1*b* shows the separation device 1 of FIG. 1*a* with an exemplary device for supplying the rotatably mounted separating element 3 with ultrasonic energy. Electrical energy is supplied to the ultrasonic transducer 6 from the ultrasonic generator 70 via a multi-core cable 71B and a contacting device 4, which has sliding contacts 41, 43, which bear against collector rings 42, 44, which are rotatably connected to the mounting shaft 2. The multicore cable 71B is connected to the sliding contacts 41, 43. Via the sliding contacts 41, alternating voltages are transmitted in the frequency range of the ultrasonic waves. The corresponding slip rings 42 are connected to connecting cables 77, via which the AC voltages are transmitted to piezo elements 631 or, optionally, to a control unit 60, in which the AC voltages are delivered to the piezo elements 631 via switches.

The ultrasonic transducer 6 preferably comprises several piezo elements 631 separated from each other by contact elements 64 (only one shown), each having a transfer opening through which the mounting shaft 2 is guided. The piezo elements 631 are pressed together by two locking elements 632 connected to the mounting shaft 2, via which ultrasonic vibrations are transmitted to the mounting shaft 2. The locking elements 632 are, for example, screw nuts, each of which is rotatably held by a thread machined into the mounting shaft 2. The piezo elements 631 can therefore be fixed in a simple manner and supplied with electrical voltages via the intermediate contact elements 64.

In preferred embodiments, a control unit 60 is arranged in the ultrasonic transducer 6, which is connected to the central control device 9. Control signals are transmitted via the cable 71B to the further sliding contacts 43, which are connected to the further collector rings 44. The control signals are transmitted via control lines 78 to the control unit 60, which subsequently controls the output of AC voltages to the piezo elements 631 and the terminal contacts 64, respectively. The control unit 60 can also comprise an ultrasonic generator to which a supply voltage can be fed via the contacting device 4 and which is provided for outputting the ultrasonic signals. In this case, the ultrasonic generator 70 shown is integrated in the control unit 60.

FIG. 1*a* and FIG. 1*b* illustrate the significant advantages of the separation device 1 according to the invention. It can be seen that with minimal constructional effort, the mounting shaft 2 can be used to act on the separating element 3 in various ways mechanically and/or with ultrasonic energy. Mechanical and acoustic vibrations, rotations as well as axial displacements can be transmitted by simple means to the mounting shaft 2, which in turn can be mounted in a simple manner so that it can be rotated and/or displaced. The mechanical movements and/or ultrasonic waves acting on the mounting shaft 2 can be transmitted centrally from the mounting shaft 2 to the at least one separating element 3.

It is also particularly advantageous that the separation device of FIGS. 1*a* and 1*b* shown in a simple embodiment can be constructed in a simple manner.

FIG. 2 shows a separation device 1 according to the invention with a mounting shaft 2, which comprises three shaft elements 2A, 2B, 2C, each of which is connected to a separating element 3A; 3B; 3C. The shaft elements 2A, 2B, 2C comprise coupling elements 21, 22 on both sides, which can be inserted into each other or screwed together. The mounting shaft 2 can thus be extended as desired, resulting in a separation device 1 with the desired number of separation elements 3A, 3B, 3C. The shaft elements 2A, 2B, 2C are preferably of identical design, but can also differ in their dimensions, in particular in length, for example in order to be able to hold separation elements 3 of different sizes. An ultrasonic transducer 6 is positively connected, possibly screwed, to the lowest shaft element 2C. Mounting shafts 2 of all separating devices 1 according to the invention can thus either be designed in one piece or consist of several shaft elements.

The separating elements 3A, 3B, 3C have openings of different sizes so that individual particles can be separated not only from each other but also in size or grouped on each of the separating elements 3A, 3B, 3C. After the working phase, the particles of the bulk material are separated in different sizes from each other and are ready for removal on the separating elements 3A, 3B, 3C. In a discharge phase, the separating elements 3A, 3B, 3C can be rotated in order to guide away the bulk material particles separated from each other by means of centrifugal force through outlet channels 5A, 5B and 5C.

The individual separating elements 3A, 3B, 3C have through-openings 30 of different sizes. This is typically provided if particles of different sizes are to be separated from each other. However, through-openings 30 of different sizes can also be provided if clumps of a bulk material are crushed in upper separating elements 3A, 3B and only finally the individual particles of the same size are separated from each other.

FIG. 3 shows a separation device 1 according to the invention with six separation elements 3A, . . . , 3F arranged in a conveying container 5, which are held by a multi-part mounting shaft 2, which is aligned with its longitudinal axis x parallel to the conveying axis of the separation device 1. In this preferred embodiment, the mounting shaft 2 has a lower shaft element 2A and an upper shaft element. 2B, which are coaxially aligned with one another and rotatably connected to one another at the ends facing one another by a coupling element 26, optionally a coupling sleeve, and which are rotatably mounted in bearing devices 58A; 58B at the ends facing away from one another. The ultrasonic transducers 6A, 6B held by the shaft elements 2A, 2B are integrated in the bearing devices 58A, 58B. Downstream of the bearing devices 58A, 58B, the contacting devices 4A, 4B, which are connected to at least one ultrasonic generator 70, are connected to the shaft elements 2A, 2B, which are further connected via an associated coupling 85A and 85B, respectively, to an associated drive motor 8A and 8B, respectively.

The lower three separating elements 3A, 3B, 3C can therefore be rotated by the lower drive motor 8A, controlled by the control program 99, while the upper three separating elements 3D, 3E, 3F can be rotated by the upper drive motor 8B, controlled by the control program 99.

Likewise, control signals and AC voltage signals can be transmitted individually via the lower and upper contacting device 4A and 4B, respectively, to the lower and upper ultrasonic transducer 6A, 6B.

The separation device 1 shown therefore comprises two smaller separation devices 1', 1" each with three separation elements 3A, 3B, 3C and 3D, 3E, 3F respectively. The lower separation device 1' with the three separation elements 3A, 3B, 3C and the upper separation device 1" with the three separation elements 3D, 3E, 3F can be operated autonomously in the same or in different process phases.

During a first process phase, a working phase program can be applied in the upper separation device 1", while a mixing phase program is applied in the lower separation device 1'. In a second process phase, a program of the working phase can be applied in the lower and the upper separation device 1', 1". In a third process phase, a program of the discharging phase can be applied in the upper separation device 1", while the lower separation device 1' is still operated in the working phase.

The mounting shaft 2 with the six separating elements 3A, . . . , 3F is arranged in a conveying container 5 which is open at the top and bottom and has a conveying channel 50 through which the bulk material S is transported by gravity. The conveying container 5 additionally has outlet openings or outlet channels 50A, . . . , 50F in the side wall, through each of which an overflow or an intermediate product Sa, Sb, Sc, Sd, Se, Sf of the bulk material S can be conveyed outwards and away from the associated separating elements 3A, . . . , 3F, as shown symbolically. In the discharge phase, the rotation speed of the separating elements 3A, . . . , 3F is increased in such a way that the intermediate products Sa, Sb, Sc, Sd, Se, Sf are carried away by centrifugal force.

The power supply device 90 shown is controlled by the control unit 9 to supply power to the motors 8A, 8B and, optionally, to the ultrasonic generator 70, which can also be integrated into the power supply device 90.

FIG. 4*a* shows an inventive separation device 1 with six separation elements 3A, . . . , 3F which are rotatably held by a mounting shaft 2 and have a flat spherical-wave form. A spherical-wave form is a waveform that results in water after a stone is thrown into it. The spherical-wave form promotes an optimal distribution of the ultrasonic waves, so that the separation of the bulk material is particularly efficient. The partitioning elements 3A, 3B, . . . preferably have one or more resonant frequencies at which maximum vibrations are generated with minimum ultrasonic energy. Especially in the working phase, the frequency of the ultrasonic waves is preferably scanned between the resonance frequencies, so that the most intensive and changing influences on the bulk material result to quickly separate it into its particles.

The separating elements 3A, . . . , 3F are connected to each other by a mounting shaft 2, which is formed in one piece or can also have several shaft elements, which are firmly connected to each other. The mounting shaft 2 is connected via a coupling 85B to an upper drive motor 8B, which can be supplied with control signals 81B from the control unit 9 or a power supply device 90 connected thereto. The mounting shaft 2 is rotatably supported and practically suspended with the upper ultrasonic transducer 6*b* in an upper bearing device 58. The conveying container 5 is for example fixed to the floor, wall or ceiling of a building by means of a bracket.

At the bottom of the separation device 1, below the lowest separating element 3F, a closing cone 55 is provided, in which the particles of the bulk material processed up to the end are collected.

The conveying container 5 has for each of the separating elements 3A, . . . , 3F a tubular inlet channel 500A, . . . , 500F and an outlet channel 501A, . . . , 501F. Through the inlet channels 500A, . . . , 500F preferably at least one powdery solid material, at least one liquid or at least one gaseous medium can be supplied to the bulk material. Through the output channels 501A, . . . , 501F material can be removed from the individual separating elements 3A, . . . , 3F or from the end cone 55.

The conveying container 5 in the present form is preferably tightly sealed so that the processing of the bulk material can be carried out under positive or negative pressure. Bulk material or bulk material components can be fed through inlet tubes 5S1, 5S2. The processed bulk material can be removed through one or two outlet tubes 5X, 5Y.

The shown embodiment of the separation device 1 thus allows to carry out various intermediate treatments of the bulk material and to aerate or deaerate it in a simple way.

At the level of each separating element 3A, . . . , 3F, any mixing process can be performed to achieve a specific mixed product or to accelerate the separation process at this level.

FIG. 4*b* shows an enlarged view of part of the separation device 1 of FIG. 4*a*. The output channels 501A, . . . , 501F are, like the input channels 500A, . . . , 500F, obliquely cut at the front. Advantageously, other shapes can also be used, for example blade shapes directed to the side, in which material can be easily collected and transported away, possibly sucked off.

FIG. 5*a* shows a separation device 1 according to the invention with helical separating elements 3A, . . . , 3L, which are rotatably mounted by means of the associated mounting shaft 2 and to which ultrasonic energy can be applied. The separating elements 3A, . . . , 3L are directed against each other in pairs and are vertically displaced against each other. An arrangement is also possible in which the separating elements 3A, . . . , 3L run continuously in the same direction in a helical or spiral shape.

With this separation device 1 all particles of the bulk material pass through the entire conveying container 5 and are completely separated from each other. This separation device 1 is preferably used when the particles of the bulk material should be separated from each other but not grouped in size.

FIG. 5*b* shows an enlarged view of part of the separation device 1 of FIG. 5*a*.

FIG. 6 shows the separation device of FIG. 2*a* in a preferred configuration with four connecting rods 321, 322, 323, 324 of different thicknesses by means of which the metal plate 31 is connected to the mounting shaft 2. The change of the diameters of the connecting rods 321, 322, 323, 324 is done according to an arithmetic or according to a geometric series. In this way, the coupling of the ultrasonic energy can be advantageously influenced. In particular, wave images can be generated in which wave nodes are reduced. Symbolically, a surface structure in the form of radial waves is shown by dashes, by means of which an interaction with the bulk material shall take place in order to move and distribute it.

FIG. 7 shows a separating element 3 as used in the device of FIG. 4. The separating element 3 or the separating plate 31 has spherical-wave form.

FIG. 8 shows a separating element 3 with a separating plate 31, which comprises a grid structure or a wire mesh 319 and which is enclosed by a ring 320, which is connected by connecting rods 321, 322, 323, 324 to the mounting shaft 2 or a mounting shaft 32, which encloses the mounting shaft 2. This separating element 3 can also be used in all devices 1 according to the invention. The separating plate 31 can be conical, as in FIG. 6, or flat or corrugated, as in FIG. 7.

It is essential that the separating elements 3 are dimensionally stable in such a way that their function is maintained under load and the bulk material is held securely.

The invention claimed is:

1. A separation device for separating particles of a bulk material, the bulk material being deliverable to an input location and provided, separated into different or unitary particle sizes, at an output location, the separation device comprising:

at least one separating element which comprises a metal separating plate provided with through-openings therein, the at least one separating element being connected to an ultrasonic transducer and provided with ultrasonic energy from the ultrasonic transducer and the at least one separating element being held by a holding device, wherein:

the holding device is a mounting shaft, which is held at one end or at both ends movably and which at the one end or at both ends is connected to the ultrasonic transducer such that ultrasonic energy is transmitted via the mounting shaft into the at least one separating element, which is dimensionally stable, the mounting shaft is rotatably held or displaceable along its longitudinal axis, or the mounting shaft is rotatably held and displaceable along its longitudinal axis, and the mounting shaft is provided with a contacting device with collector rings and sliding contacts, via which alternating voltage signals or direct voltage signals are transferable to the ultrasonic transducer, the contacting device being supplied with alternating voltage signals with a constant or variable frequency by an ultrasonic generator.

2. The separation device according to claim 1, wherein:

the separating plate has a flat or curved surface or the separating plate has a constant thickness or a thickness that reduces towards the outside, or the separating plate has a flat or curved surface and a constant thickness or a thickness that reduces towards the outside.

3. The separation device according to claim 1, wherein the separating plate has a grid structure or a wire mesh structure, the separating plate being connected to the mounting shaft by at least one mounting element, such as a connecting sleeve or at least two connecting rods, the at least two connecting rods having the same or different diameters.

4. The separation device according to claim 1, wherein:

the at least one separating element has a central axis and is rotationally symmetrical with respect to this central axis, and the mounting shaft is aligned coaxially to the central axis.

5. The separation device according to claim 1, wherein the separating plate of the at least one separating element has a basic structure, the separating plate being provided for mechanical interaction with the bulk material.

6. The separation device according to claim 1, wherein the separating plate is connected to the mounting shaft by at least one mounting element or by at least two connecting rods having the same or different diameters.

7. The separation device according to claim 6, wherein:

the at least one separating element is a plurality of separating elements, the mounting shaft comprises a plurality of shaft elements, each of the plurality of shaft elements is detachably connected to a respective separating element of the plurality of separating elements, and the plurality of shaft elements are positively connected to each other, rotatably connected to each other, screwed together, or welded together.

8. The separation device according to claim 1, wherein the mounting shaft is connected at the one end to a drive motor or at both ends to a plurality of drive motors such that the mounting shaft or two shaft elements of the mounting shaft can be driven individually in one or the other direction or alternately in the one and the other direction about the longitudinal axis of the mounting shaft.

9. A separation device according to claim 1, wherein control signals are transferable to the ultrasonic transducer from the contacting device, and the alternating voltage signals supplied by the ultrasonic generator are in the frequency range of 20 kHz to 45 kHz.

10. The separation device according to claim 9, wherein:

the ultrasonic transducer includes ring-shaped piezoelectric elements that are clamped between two metal elements or metal plates, the two metal elements or metal plates being connected to the mounting shaft in a form-fitting manner, screwable manner, force-fitting manner or in one piece, and the ring-shaped piezoelectric elements are connected to the ultrasonic generator by means of connection contacts and the contacting device.

11. The separation device according to claim 1, wherein the mounting shaft with the at least one separating element connected thereto is arranged in a conveying container having an open or closable through channel through which the bulk material can be transported from the input location to the output location.

12. The separation device according to claim 11, wherein the conveying container has an outlet opening for the at least one separating element.

13. The separation device according to claim 8, further comprising:

a power supply device which is connected to the drive motor or the plurality of drive motors, and a control unit with a control program for controlling the separating of the particles of the bulk material.

14. A method of operation for controlling the separation device according to claim 1, wherein:

in a mixing phase a drive motor or a plurality of drive motors are controllable in such a way that the mounting shaft is rotated at a mixing speed by a fraction of a revolution corresponding to a switching frequency in one direction and again in the other direction, or in a discharge phase the mounting shaft is rotated at a discharge speed by a multiple of a revolution in one or the other direction, wherein the mixing speed and the switching frequency are selected such that the bulk material is mixed and the discharge speed is selected such that remaining bulk material is removed by centrifugal force from the at least one separating element.

15. The method of operation for controlling the separation device according to claim 14, wherein in the mixing phase the bulk material is removed from the at least one separating element or wherein in the mixing phase supplementary materials are added to the at least one separating element.

* * * * *